US009482023B1

(12) United States Patent
Carmody

(10) Patent No.: US 9,482,023 B1
(45) Date of Patent: Nov. 1, 2016

(54) POST PROTECTOR

(71) Applicant: Scott Carmody, Palm Bay, FL (US)

(72) Inventor: Scott Carmody, Palm Bay, FL (US)

( * ) Notice: Subject to any disclaimer, the term of this patent is extended or adjusted under 35 U.S.C. 154(b) by 49 days.

(21) Appl. No.: 14/603,584

(22) Filed: Jan. 23, 2015

Related U.S. Application Data

(60) Provisional application No. 61/935,474, filed on Feb. 4, 2014.

(51) Int. Cl.

| | |
|---|---|
| ***E01F 15/14*** | (2006.01) |
| ***E04H 12/22*** | (2006.01) |
| ***E04C 3/30*** | (2006.01) |
| ***E02D 5/60*** | (2006.01) |
| ***E04B 1/92*** | (2006.01) |

(52) U.S. Cl.
CPC ..... *E04H 12/2292* (2013.01); *E01F 15/141* (2013.01); *E02D 5/60* (2013.01); *E04B 1/92* (2013.01); *E04C 3/30* (2013.01)

(58) Field of Classification Search
CPC .. E04H 12/2292; E04H 12/22; E04F 15/141; E04B 1/92; E02D 5/60; E04C 2002/004; E04C 3/30; E04C 3/127
See application file for complete search history.

(56) References Cited

U.S. PATENT DOCUMENTS

| | | | | |
|---|---|---|---|---|
| 5,622,356 | A | 4/1997 | Duggan | |
| 5,956,920 | A * | 9/1999 | Davis | E04C 3/30 52/236.1 |
| 6,357,196 | B1 * | 3/2002 | McCombs | E04C 3/14 138/166 |
| 2005/0229531 | A1 * | 10/2005 | Green | A47B 96/202 52/834 |
| 2006/0010823 | A1 * | 1/2006 | Waters | E04C 3/30 52/834 |
| 2007/0245645 | A1 | 10/2007 | Nesbitt | |
| 2008/0000192 | A1 * | 1/2008 | McGlinch | E04H 12/2292 52/835 |
| 2010/0223882 | A1 * | 9/2010 | Parenti | E04C 3/36 52/834 |
| 2010/0236182 | A1 * | 9/2010 | Mackenzie | E04C 3/30 52/588.1 |

* cited by examiner

*Primary Examiner* — Jessica Laux
(74) *Attorney, Agent, or Firm* — Brian S. Steinberger; Law Offices of Brian S. Steinberger, P.A.

(57) ABSTRACT

Devices, apparatus, kits, systems and methods for protecting sides of wood or plastic posts from damage from lawn equipment with easily attachable plastic panels, and for providing marking surfaces, such as addresses for the posts, as well as a surface for applying desirable colors and indicia designs thereon. The panels can have hook end along one side edge, and a raised protrusion edge along an opposite side edge, that slide or snap with one another. One or multiple panels can be attached about a base of a post such as a rectangular or circular cross-section mailbox post or fence post, and the like.

13 Claims, 10 Drawing Sheets

POST PROTECTOR

This application claims the benefit of priority to U.S. Provisional Application Ser. No. 61/935,474 filed Feb. 4, 2014, the entire disclosure of which is incorporated herein by reference.

FIELD OF INVENTION

This invention relates to posts for mailboxes and fences, and in particular to devices, apparatus, kits, systems and methods for protecting sides of new or existing posts with easily attachable panels made from a durable material, and for providing marking surfaces, such as addresses for the posts, as well as a surface for applying desirable colors and indicia designs thereon.

BACKGROUND AND PRIOR ART

Many mailboxes are mounted on wooden type posts, such as a rectangular or circular cross-sectional post. Cutting grass and weeds about the base of these posts are often done with automated cutting tools such as line trimmers, often referred to as WEED WACKERS™. These trimmers are able to trim edges of lawns by a motor driven flexible wire or plastic or nylon type cord. Often the trimmer lines constantly striking the posts cause unsightly indentations such as grooves and cuts into the surface areas of the posts. The indentations can often attract dirt and debris that can also become discolored and tend to shorten the lifespan of the posts.

Another problem with wooden posts is that it can be difficult to place indicia such as street addresses, etc., since tape type lettering and numbering often does not stick to the wooden surfaces. Nailing numbers and address indicia would not be desirable since the nails and fasteners can split the wood and further reduce the post lifespan over time.

Other types of posts such as wooden fence posts can also have similar problems where rotating trimmer lines also cause unsightly indentations, that also can become discolored, and can shorten the lifespan of the posts over time.

Thus, the need exists for solutions to the above problems with the prior art.

SUMMARY OF THE INVENTION

A primary objective of the present invention is to provide devices, apparatus, kits, systems and methods for protecting sides of posts such as wooden mailbox posts and wooden fence posts with easily attachable plastic panels.

A secondary objective of the present invention is to provide devices, apparatus, kits, systems and methods for marking surfaces on wooden mailbox posts and/or wooden fence posts for addresses and for desirable colors and indicia designs thereon.

A third objective of the present invention is to provide devices, apparatus, kits, systems and methods for protecting sides of wooden posts from nicks, cuts and scrapes from lawn maintenance equipment and further improves the appearance the property.

A fourth objective of the present invention is to provide devices, apparatus, kits, systems and methods for protecting sides of plastic posts protect the plastic post from scuffs and damage using replaceable panels without having to replace the expensive plastic posts.

A fifth objective of the present invention is to provide devices, apparatus, kits, systems and methods for protecting sides of posts that are made of a durable material to protect and decorate the mailbox, deck, pergola, fence, garden, and utility and recreation posts.

A sixth objective of the present invention is to provide devices, apparatus, kits, systems and methods for protecting sides of posts with panels having a moisture protection barrier to protect the post from mold and mildew.

A seventh objective of the present invention is to provide devices, apparatus, kits, systems and methods for protecting sides of posts with panels have hinged corners to allow movement to better-fit cracked, warped or misshapen posts.

An eighth objective of the present invention is to provide devices, apparatus, kits, systems and methods for protecting sides of posts with panels having corners that are rounded and enhanced to reduce ware and damage to the lawn maintenance equipment.

A ninth objective of the present invention is to provide devices, apparatus, kits, systems and methods for protecting sides of posts with panels having sides made smooth with a non-abrasive surface to reduce ware and damage to the lawn maintenance equipment.

A tenth objective of the present invention is to provide devices, apparatus, kits, systems and methods for protecting sides of posts with panels that are interchangeable, so that panels with different sizes, colors, designs, indicia, and the like, are attachable to one another.

A eleventh objective of the present invention is to provide devices, apparatus, kits, systems and methods for protecting sides of posts with panels that come in different widths and heights to protect and cover the entire post, so that panels with different colors, designs, indicia, and the like, are attachable to one another.

An embodiment of the post protector, can include a plurality of planar plastic rectangular or circular panels, each panel having a top edge, a bottom edge, a left side edge and a right side edge, with the top edge being parallel to the bottom edge, and the left edge being parallel to the right edge, where each of the panels having a hook portion on one of the left side edge and the bottom side edge, and where each of the panels having a protruding portion along an opposite side edge to the side edge having a hook portion, wherein the plurality of panels are interconnected with one another by fitting the protruding portion of each panel into the hook portion of an adjacent panel adaptable to form a barrier about a post to be protected.

Each panel can be formed from plastic with the hook portion and protruding portion molded into the plastic.

The plurality of rectangular or circular or curved panels can include one or multiple panels adapted to form a rectangular or circular or circular base about the post.

The underlying post can be a mailbox post. The underlying post can be a fence post.

Each of the panels can include different colors. The panels can include designs or indicia screen printed on the panels. Alternatively, the panels can include addresses, such as streets and building numbers. The indicia and/or designs can be engraved on the panels, and/or painted and/or screen printed and/or formed in other ways typical in the art.

A method of protecting posts, can include the steps of providing a plurality of planar plastic rectangular or circular panels, each panel having a top edge, a bottom edge, a left side edge and a right side edge, with the top edge being parallel to the bottom edge, and the left edge being parallel to the right edge, providing a hook portion along one of the left side edge or the right side edge of each panel, providing a protruding portion along another side edge of the panel opposite to the side edge having the having a hook portion, and attaching the plurality of panels about a post by sliding the protruding portions of one panel into the hook portions on an adjacent edge until a full perimeter circumference about the post is protected.

Each of the plastic panels can include the hook portion and the protruding portion molded on the panels. The plurality of panels can include three panels, or four panels or more panels Further objects and advantages of this invention will be apparent from the following detailed description of the presently preferred embodiments which are illustrated schematically in the accompanying drawings.

DESCRIPTION OF THE PREFERRED EMBODIMENTS

Figure 1A:
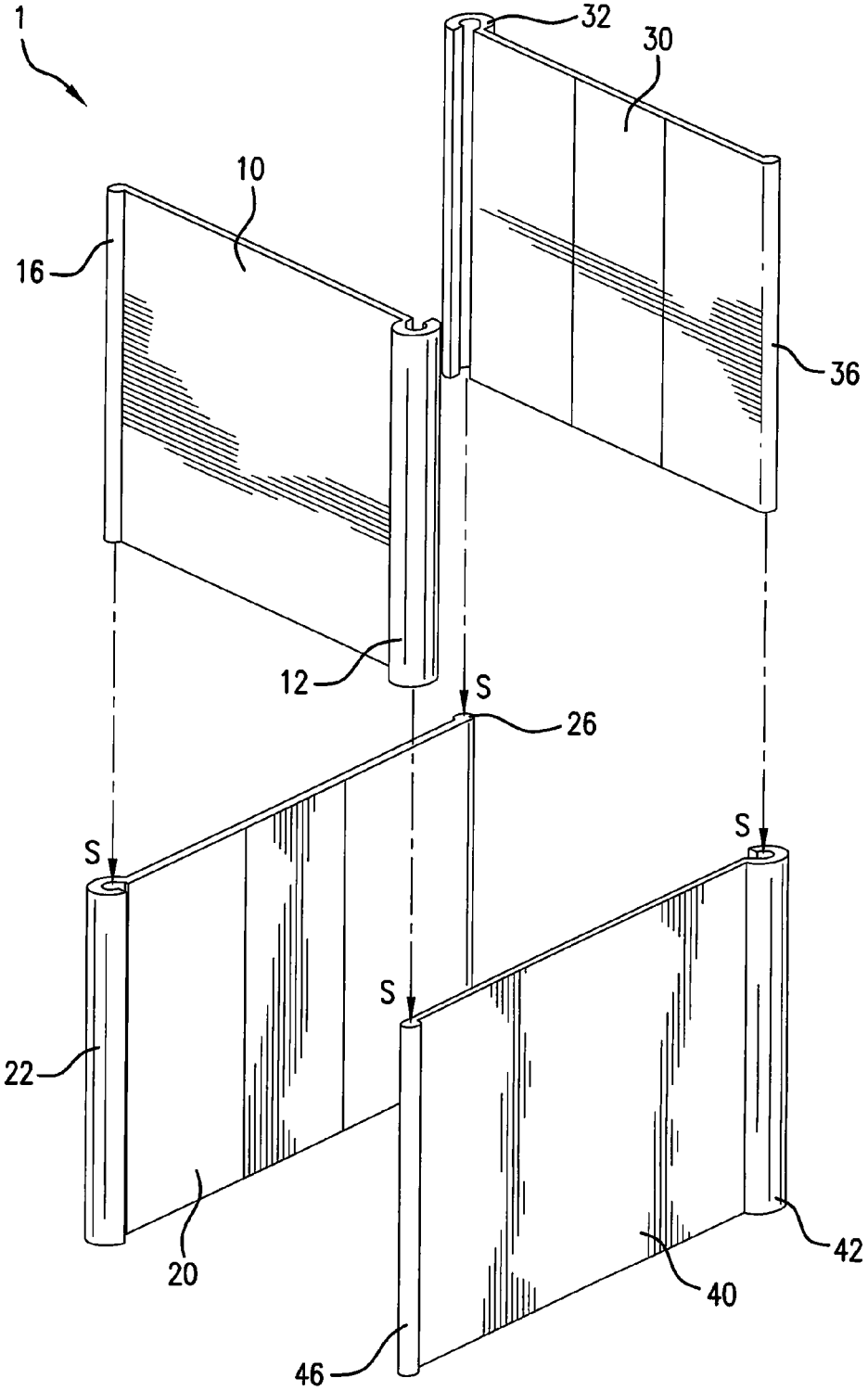
FIG. 1A is an exploded view of the attachable post panels for the invention with hook portions and protrusion portions that slidably attach with one another.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components referenced in the figures will now be described.

1 post protector
10 first panel
14 ribs and/or moisture strips
12 rounded hook end with open slit
16 bent protruding portion end with enlarged head
20 second panel
22 rounded hook end with open slit
26 bent protruding portion end with enlarged head
30 third panel
32 rounded hook end with open slit
36 bent protruding portion end with enlarged head
40 fourth panel
42 rounded hook end with open slit
46 bent protruding portion end with enlarged head
100 post for mailbox
200 elongated panel post protector
210 first panel
220 second panel
230 third panel
240 fourth panel
310 another embodiment panel with different shaped protruding end
312 rounded hook end with open slit
314 ribs and/or moisture strips
316 sideways bent protruding portion The invention embodiments can be used and sized in height and width to fit about various types of rectangular or circular cross-section posts, such as but not limited to posts being 4"×4", 4"×6", "6×6", and the like, as well as other sizes and the like.

Each of the posts sizes can have respective sized panels, such as having a width of approximately 4" and a height of approximately 4 & ½ ".

FIG. 1A is an exploded view of the attachable post panels 10, 20, 30, 40 for the invention each with rounded hook ends 12, 22, 32, 42 each having open slit sides and opposite ends 16, 26, 36, 46 having sideways bent protruding portions that can slidably attach and detach with one another.

Referring to FIG. 1A, a sideway bent protruding portion with an enlarged head of one panel can slide into the respective rounded hook end with open slit of an adjacent panel, and vice versa. For example, panels 20 and 40 can be arranged in upright vertical positions substantially parallel to one another and spaced apart the approximate width of one of the panels 10-40. Next, the sideway bent protruding portion 16 and rounded hook end 12 with open slit of panel 10 can be in a raised position and slid downward in the direction of arrows S into respective rounded hook end 22 with open slit of panel 20 and about the sideway bent protruding portion 46 of panel 40. Next the rounded hook end 32 with open slit, and sideway bent protruding portion 36 of panel 30 can be in a raised position and then slid downward in the direction of arrow S about respective sideway bent protruding portion 26 of panel 20, as well as into rounded hook end 42 with open slit of panel 40.

Figure 1B:
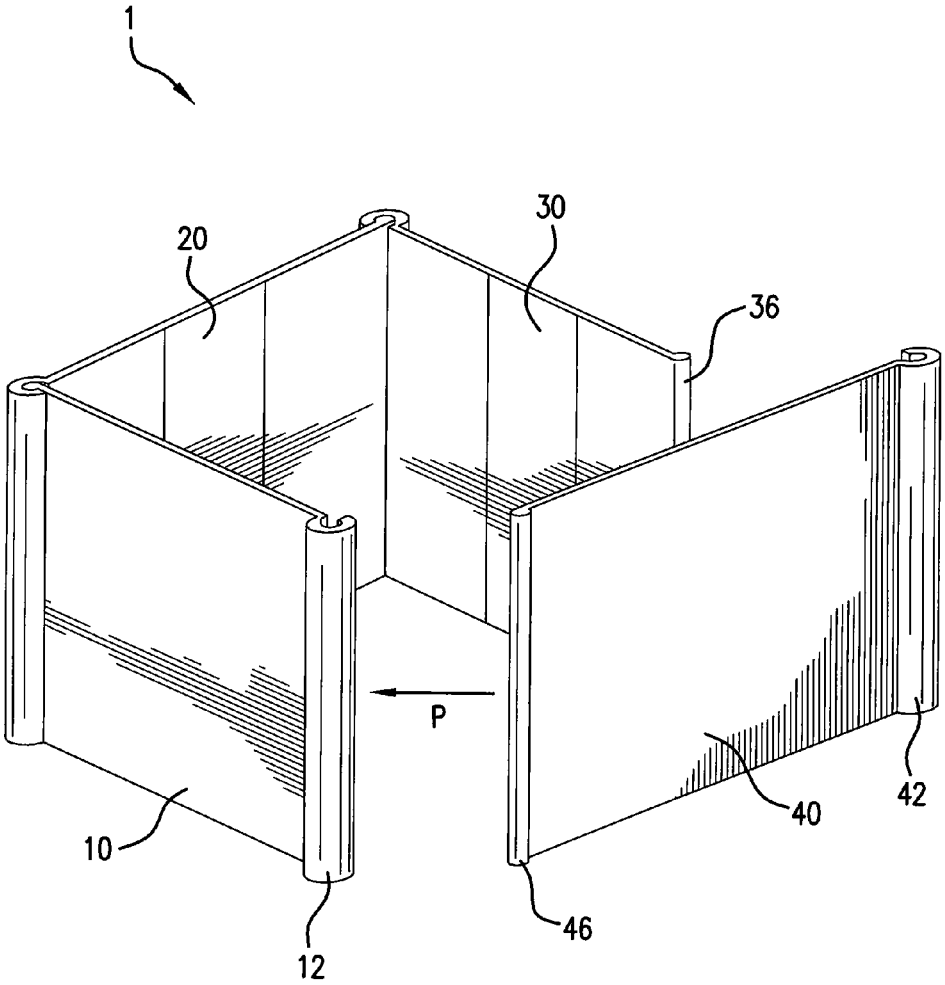
FIG. 1B is another view of the attachable panels being able to snap to one another.
Figure 1C:
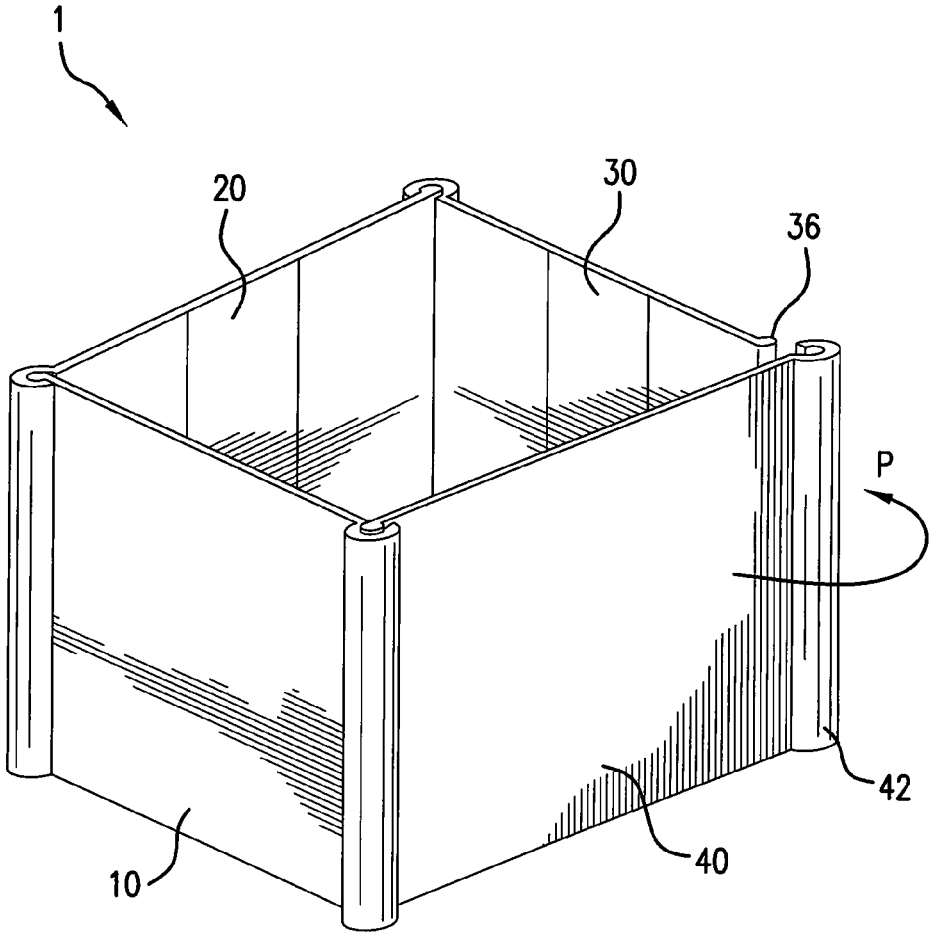
FIG. 1C shows another view of the panels of FIG. 1B with hook portion of last panel snapably attaching to protrusion portion of adjacent panel.
Figure 1D:
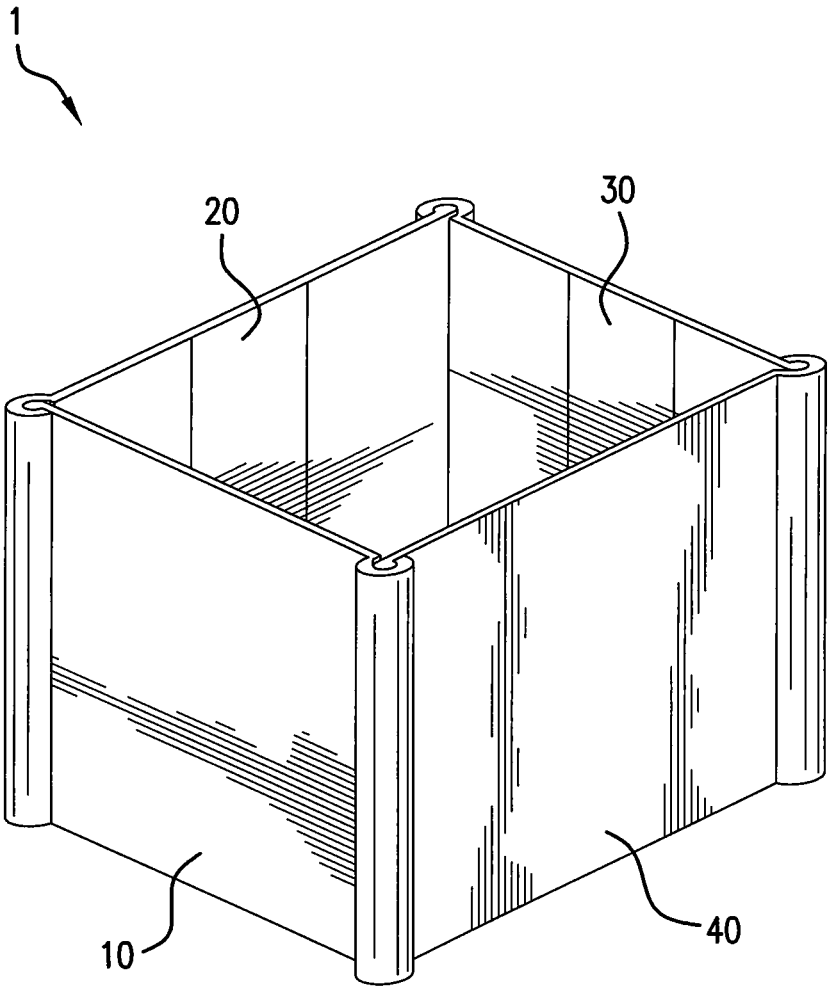
FIG. 1D shows multiple panels of the preceding figures assembled and attached together.

FIG. 1B is another view of the attachable panels 10, 20, 30, 40, each being able to snap onto ends of an adjacent panel. FIG. 1C shows another view of the panels of FIG. 1B with hook portion 42 of last panel 40 snapably attaching to sideways bent protruding portion 36 of adjacent panel 30. FIG. 1D shows multiple panels of the preceding FIG. 1A or 1B and 1C, assembled and attached together.

Referring to FIGS. 1B-1D, panels 10, 20, 30, and 40 can also be snapped together. For example, sideway bent protruding portion 46 of panel 40 can be inserted into the interior facing slit of round hook end 12 of adjacent panel 10, and is able to snap into place.

Figure 3:
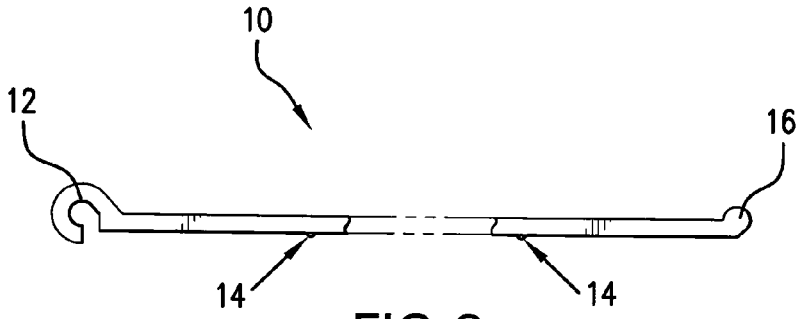
FIG. 3 is a top view of one of the panels of the preceding figures.

FIG. 3 shows a top view of panel 10 having sideway bent protruding portion 16 with a generally rounded head, and an opposite end having a rounded hook end 12 with open slit. Each of the panels 10-40 can have a generally rectangular or circular main body configuration with a hook end 12, 22, 32, 42 along one side edge, and a sideway bent protruding portions 26, 26, 36, 46 along an opposite side edge, with adjacent panels being assembled together by sliding the side edge with the sideway bent protruding portion into the rounded hook end with slit in the side edge of the adjacent panel.

Referring to FIGS. 1B, 1C, 1D and 3-4, the sideway bent protruding portion 46 of panel 40 can be pushed in the direction of arrow P by the installer to slightly spread apart the slit of the rounded hook end 12 of adjacent panel 10, so that the protruding portion 46 with an enlarged head is inserted through the slit into the interior opening in the hook 12, which can then snap about the generally rounded head of sideway bent protruding portion 46 of panel 40. Each of the adjacent panels 10, 20, 30 and 40 can be similarly attached to one another in a similar push and snap assembly.

Figure 2A:
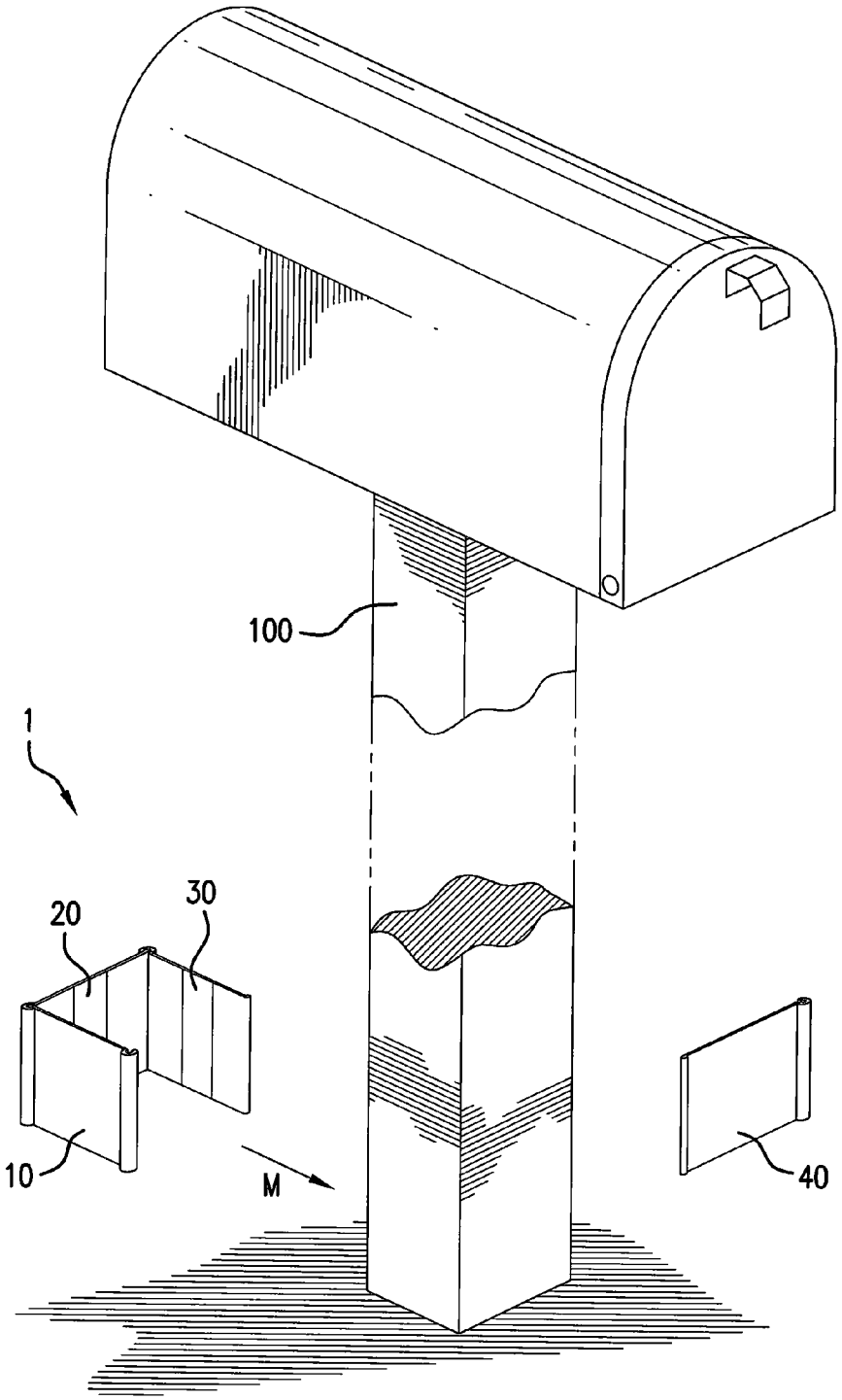
FIG. 2A shows the panels of FIG. 1 ready to assemble to a lower end of a mailbox post.
Figure 2B:
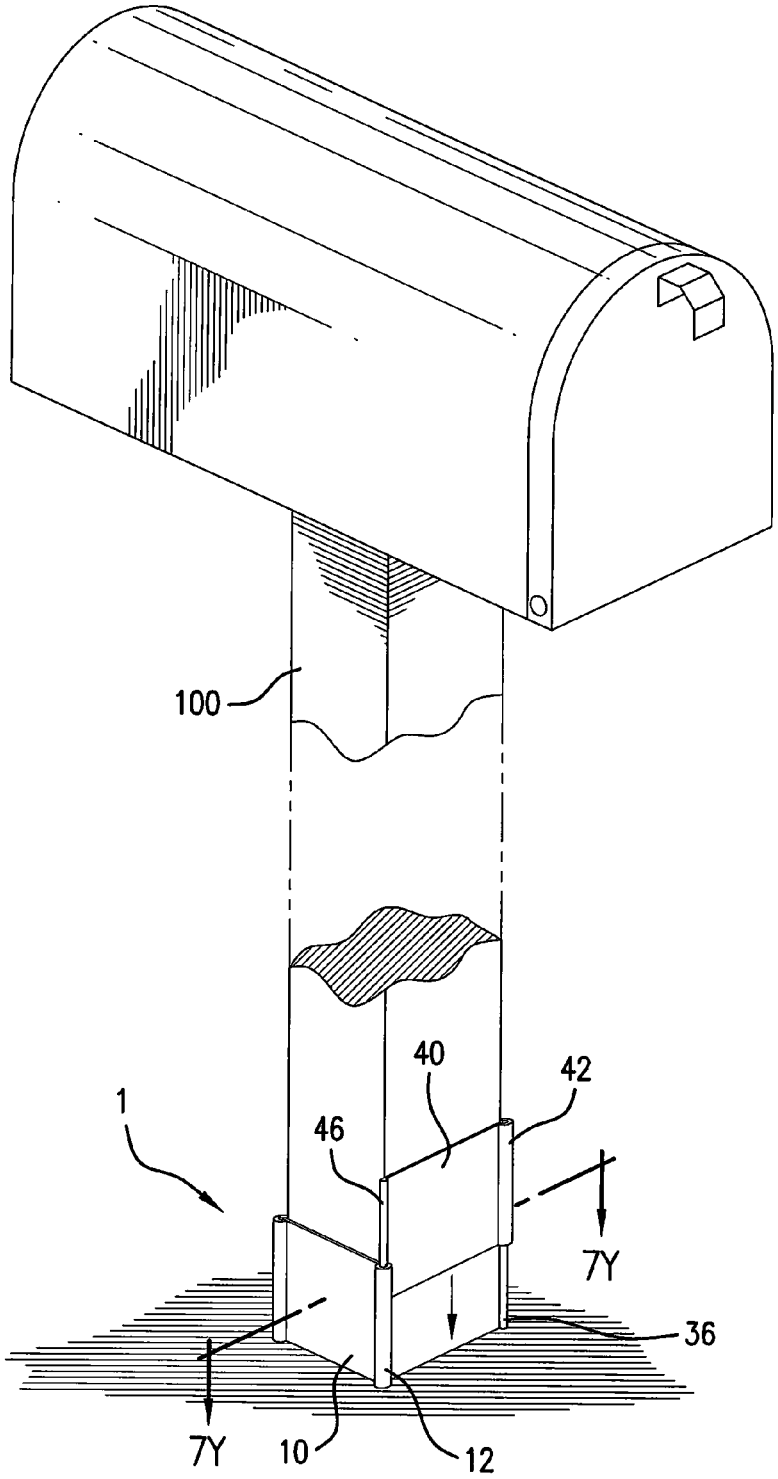
FIG. 2B the panels of FIG. 2A almost assembled about a lower end of a mailbox post.

FIG. 2A shows the panels 10, 20 and 30 of FIG. 1 ready to assemble to a lower end of a mailbox post 100. FIG. 2B the panels 10, 20, 30 and 40 of FIG. 2A almost assembled about a lower end of a mailbox post 100.

Referring to FIGS. 1A, 1B, 2A, 2B, 3-4, three of the panels 10, 20, 30 can be attached to one another by having ends slid into adjacent hook ends or vice versa, or the sideway bent protruding portions snapped into slits of rounded hook ends of adjacent panels, as described above. Once three panels 10, 20, 30 are assembled together, they can be moved in the direction of arrow M about a lower portion of post 100. Next, the last panel 40 can be slid downward or snapped in place with adjacent panels 10, 30.

Figure 2C:
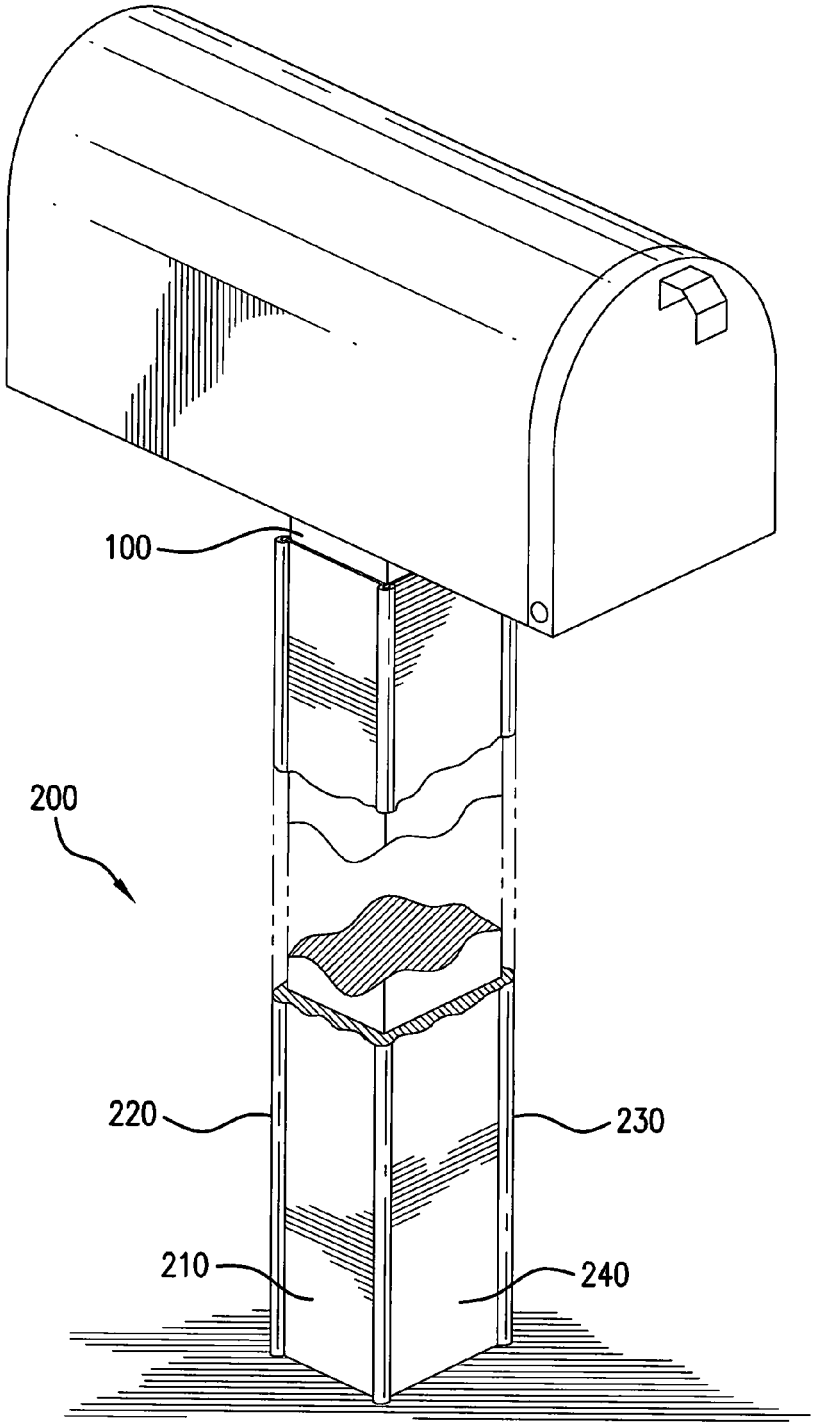
FIG. 2C shows extended length panels of FIG. 2A almost assembled about a lower end of a mailbox post.

FIG. 2C shows another embodiment 200 of extended length panels 210, 220, 230, 240, almost assembled about the entire mailbox post 100. Here, larger height panels 210, 220, 230 and 240 can be slid into place or snapped into place in a manner similar to the embodiments described above. This larger size version of panels 210, 220, 230 and 250 can be used for protecting and covering the post from lawn maintenance equipment, weathering and discoloration.

Figure 4:
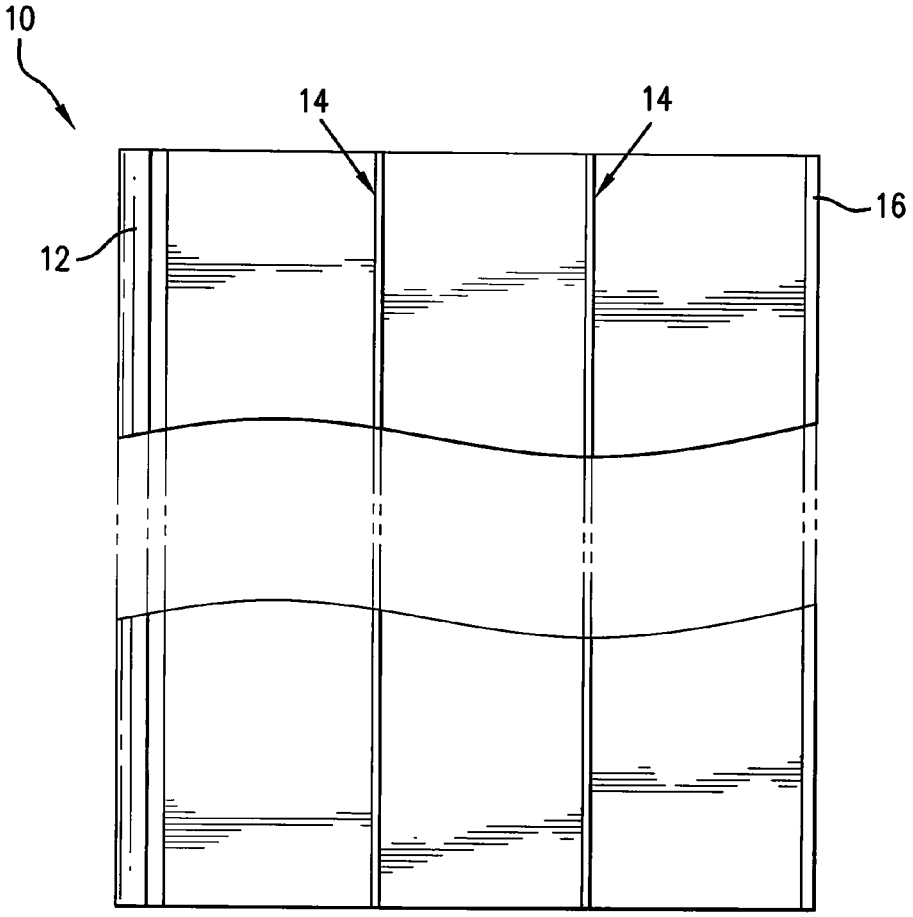
FIG. 4 is a front view of the panel of FIG. 3.

FIG. 3 is a top view of one of the panels 10 of the preceding figures. FIG. 4 is a front view of the panel 10 of FIG. 3 which also shows optional vertical ribs 14, which can be used for causing better gripping action between the inside of each panel and the side surfaces of the post 100. While the ribs 14 are shown vertical, the ribs 14 can be arranged in horizontal parallel rows, or other configurations such as crossed, and different combinations, and the like. The ribs 14 can be raised molded on portions of the plastic panels Alternatively, components 14 can be moisture barrier strips which can protect the sides of the posts 100 from mold and mildew.

Figure 5:
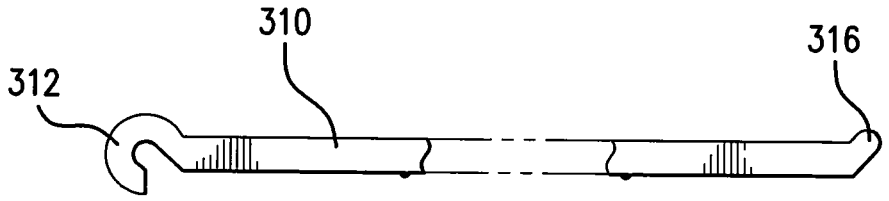
FIG. 5 is a top view of another embodiment of another panel for the invention.
Figure 6:
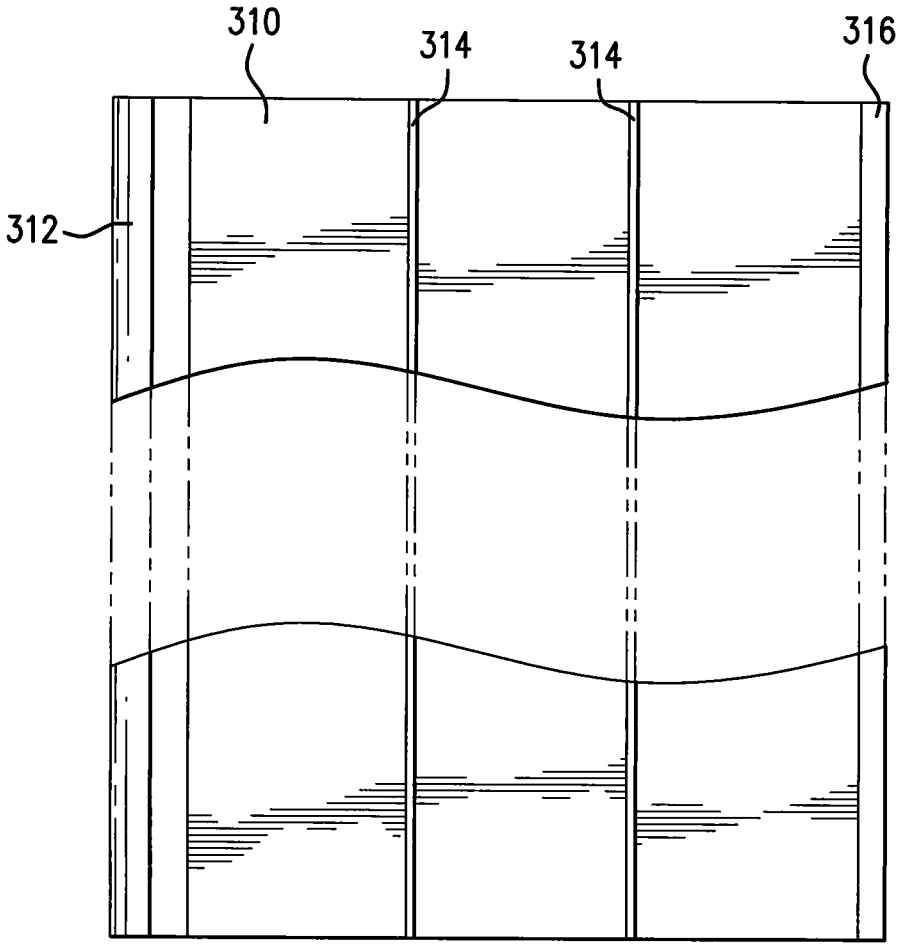
FIG. 6 is a front view of the panel of FIG. 5.

FIG. 5 is a top view of another embodiment of another panel 310 for the invention. FIG. 6 is a front view of the panel 310 of FIG. 5. Referring to FIGS. 5-6, panel 310 can include a rounded hook end 312 with open slit on one end, and an opposite end having a sideways bent protruding portion 316, which can have a different shaped head than the previous embodiment panels. Here, portion 316 can have a blunt tipped head that does not have a larger diameter than the thickness of the enlarged heads of sideway bent protrusions of the previously described panels. Component 314 can parallel molded on ribs and/or moisture strips similar to those previously described.

Figure 7:
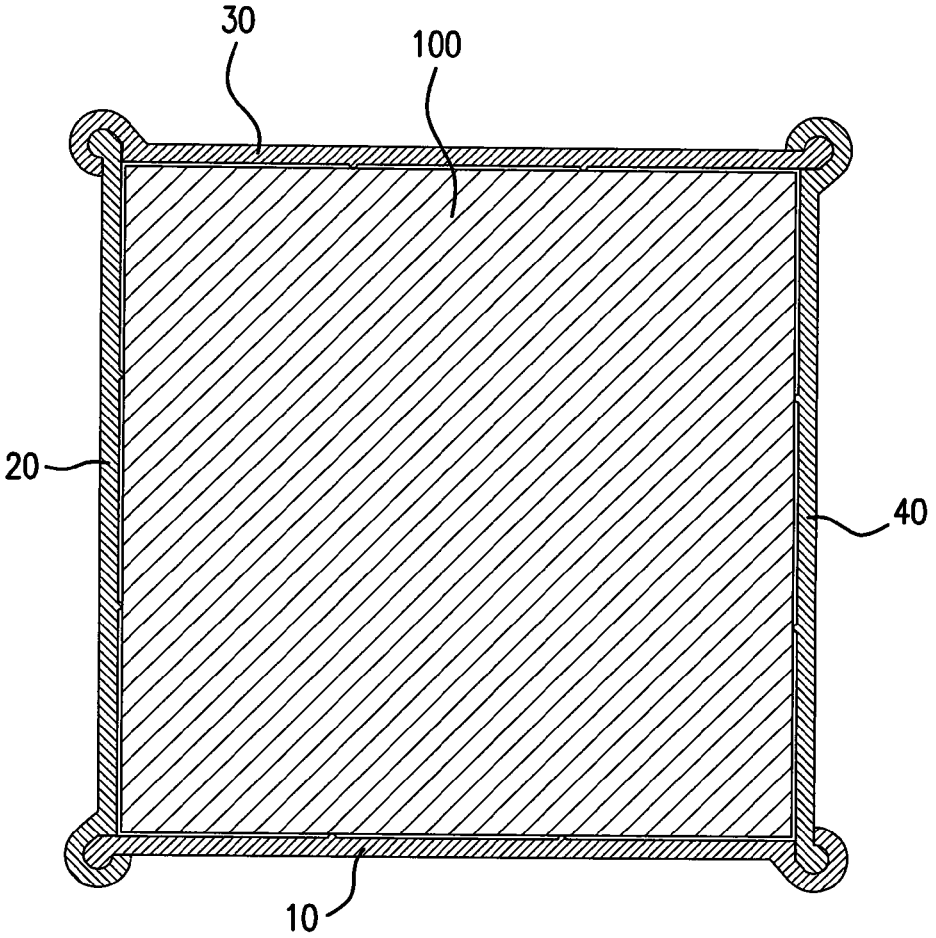
FIG. 7 is a top cross-sectional view along arrows 7Y of FIG. 2B showing the assembled panels attached about a post.

FIG. 7 is a top cross-sectional view along arrows 7Y of FIG. 2B showing the assembled panels 10-40 attached about a post 100. As shown, the inside walls of panels 10, 20, 30, 40 can rest close to touch against the sides of posts 100.

While the panels 10, 20, 30, 40, 210, 220, 230, 240, 310 are shown as generally planar panels, the invention can be used with the panels having slightly concave bent mid portions which allow at least the interior bending portions to be able to touch and/or grip against side exterior surfaces of the underlying posts.

The novel post protectors described above can be used to protect and cover posts from nicks, cuts and scrapes from lawn maintenance equipment and improves the appearance of the property.

The novel post protectors can be made of a durable material, such as but not limited to plastic, and the like, to protect and decorate the mailbox, deck, pergola, fence, garden, and utility and recreation posts. The panels can be formed from molded plastic, extruded plastic, and the like.

Although the preferred embodiment has the posts being wooden, the novel post protectors can also be used on the plastic post. The shields will protect the plastic post from scuffs and damage and can be replaced without having to replace the more expensive plastic post.

The novel panels have hook portions that also form hinged corners to allow movement to better-fit cracked, warped or misshapen posts.

The corners on each of the panels, can be rounded and enhanced to reduce ware and damage to the lawn maintenance equipment.

The sides of the panels can be made smooth with a non-abrasive surface to reduce ware and damage to the lawn maintenance equipment.

The novel panels are interchangeable with panels having different colors, different designs, and the like.

Although the embodiments show multiple panels being assembled to one another by sliding protruding portions along one side of a panel into hook portions along an adjacent panel, the post protectors can use as little as three panels attached to one another. Additionally, the panels can be assembled to have five or more panels interconnected with one another.

The panels can each be of the same size. Alternatively different sized panels can be attached to one another to fit about different diameter posts. Although only the bases of the posts are shown protected, the panels can be arranged to run up part of or substantially up most of the sides of the posts as needed.

The panels can be formed from different indicia, such as different colors, and the like. For example, a college team colors can be combined on one panel or the panels can have different colors thereon. Additionally, other types of designs, indicia, and the like, can be painted on the panels, Also, the colors, designs, indicia and the like, can be screen printed on the panels. Additionally, other information, such as but not limited to street addresses, and the like, can be painted on the panel surfaces, or screen printed thereon, or applied by other techniques, such as but not limited to applying tape with the numbers and address information to the surfaces of the panels.

Although the hook edges are shown being longitudinal generally across the entire side edge, the hook edges can be spaced apart from one another.

While the posts being protected are generally shown having rectangular or circular cross-sections, other types of posts having cylindrical cross-sections, and other shapes can be protected.

While the panels are shown having generally flat planar surfaces, the panels can have non planar surfaces, such as but not limited to rounded surfaces for fitting about other shaped posts, such as cylindrical posts, and other non-rectangular or circular cross-section posts, and the like.

Although the panels are shown as rectangular or circular, other geometrical shapes can be used, such as but not limited to hexagon, triangular, and the like, and other shapes.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A post protector, comprising:

a plurality of planar molded plastic rectangular flat panels, each panel having a front side, a rear side, a top edge, a bottom edge, a left side edge and a right side edge, with the top edge being parallel to the bottom edge, and the left edge being parallel to the right edge, and a central portion extending entirely from the left side edge to the right side edge in a single plane;

each of the rectangular flat panels being unitary and monolithic, each of the unitary and monolithic rectangular flat panels having an elongated hook portion along the left side edge so that the left side edge consists of the elongated hook portion, the elongated hook portion having a shape consisting of elongated C shape with a convex exterior curved surface and a single elongated slot that passes into a partial circular inner cavity, the convex exterior curved surface of the elongated C shape extending outward and bending left from the front side of each panel with the single elongated slot facing outward from the rear side of the panel; and each of the unitary and monolithic rectangular elongated flat panels having an elongated solid protruding portion with a solid partial circular tip, along the right side edge which is an opposite side edge to the side edge having the elongated hook portion, so that the right side edge consists of the elongated solid protruding portion with a solid partial circular tip which extends outward and bending right from the front side of each panel, wherein the plurality of panels are interconnected with one another by fitting the solid partial circular tip of the protruding portion of each panel into the single elongated slot and partial circular inner cavity of the elongated hook portion of an adjacent panel adaptable to form a barrier about a post to be protected.

2. The post protector of claim 1, wherein the plurality of rectangular flat panels includes one or multiple panels adapted to form a rectangular base about the post.

3. The post protector of claim 1, wherein the panels include different colors.

4. The post protector of claim 1, wherein the panels include designs or indicia screen printed on the panels.

5. A method of protecting posts, comprising the steps of: providing a plurality of molded planar plastic flat rectangular panels that are each unitary and monolithic, each rectangular flat panel having a front side, a rear side, a top edge, a bottom edge, a left side edge and a right side edge, with the top edge being parallel to the bottom edge, and the left edge being parallel to the right edge, and a central portion extending entirely from the left side edge to the right side edge in a single plane;

providing a hook portion along the left side edge of each rectangular flat panel, so that the left side edge consists of the elongated hook portion, the elongated hook portion having a shape consisting of elongated C shape with a convex exterior curved surface and a single elongated slot that passes into a partial circular inner cavity, the convex exterior curved surface of the elongated C shape extending outward and bending left from the front side of each panel with the single elongated slot facing outward from the rear side of the panel;

providing an elongated protruding portion along the right side edge of the panel opposite to the left side edge having the elongated hook portion, so that the right side edge consists of the elongated solid protruding portion with a solid partial circular tip which extends outward and bending right from the front side of each panel;

attaching the plurality of the unitary and monolithic rectangular flat panels about a post by sliding or snapping the elongated protruding portion of each rectangular flat panel into the elongated hook portions on an adjacent rectangular flat panel until a full perimeter circumference about the post is protected.

6. The method of claim 5, wherein the plurality of panels includes three panels.

7. The method of claim 5, wherein the plurality of panels includes multiple panels.

8. The method of claim 5, wherein the post is a mailbox post.

9. The method of claim 5, wherein the post is a fence post.

10. The method of claim 5, wherein the panels have different colors.

11. The method of claim 5, wherein the panels have designs.

12. The method of claim 5, wherein the panels have screen printing thereon.

13. The method of claim 5, wherein the panels have addresses thereon.

* * * * *